United States Patent [19]

Spier

[11] Patent Number: 4,601,528

[45] Date of Patent: Jul. 22, 1986

[54] HERMETIC SELF-LOCKING ELECTRICAL CONNECTOR

[76] Inventor: I. Martin Spier, 50 Park Ave., New York, N.Y. 10016

[21] Appl. No.: 767,739

[22] Filed: Aug. 20, 1985

[51] Int. Cl.[4] ..... H01R 13/627

[52] U.S. Cl. ..... 339/38; 339/91 R; 339/94 M

[58] Field of Search ..... 339/38, 60 R, 60 C, 339/60 M, 61 R, 61 C, 61 M, 63 R, 63 M, 94 R, 94 A, 94 M, 91 R

[56] References Cited

U.S. PATENT DOCUMENTS

| | | | |
|---|---|---|---|
| 1,871,397 | 8/1932 | Watts | 339/60 R |
| 2,037,630 | 4/1936 | Hudson | 173/328 |
| 2,761,111 | 8/1956 | Klostermann | 339/91 R |
| 2,782,391 | 2/1957 | Kirk | 339/60 R |
| 2,840,676 | 6/1958 | King | 339/60 R |
| 3,199,060 | 8/1965 | Marasco | 339/60 R |
| 3,474,386 | 10/1969 | Link | 339/60 |
| 3,611,255 | 10/1971 | Shroyer | 339/60 R |
| 3,665,368 | 5/1972 | Ellis | 339/60 R |
| 3,688,244 | 8/1972 | Savoca et al. | 339/60 M |
| 3,707,696 | 12/1972 | Carter | 339/70 F |
| 3,747,048 | 7/1973 | Johnson et al. | 339/94 R |
| 3,757,789 | 9/1973 | Shanker | 128/404 |
| 3,832,674 | 8/1974 | Florian | 339/60 R |
| 3,880,487 | 4/1975 | Goodman et al. | 339/60 R |
| 3,937,545 | 2/1976 | Cairns et al. | 339/60 R |
| 4,090,759 | 5/1978 | Herrmann, Jr. | 339/60 M |
| 4,116,521 | 9/1978 | Herrmann, Jr. | 339/60 R |
| 4,291,932 | 9/1981 | Cox | 339/60 R |
| 4,417,736 | 11/1983 | Herrmann | 277/212 R |
| 4,421,369 | 12/1983 | Myking | 339/94 A |
| 4,422,704 | 12/1983 | Williams | 339/91 R |

*Primary Examiner*—John McQuade

*Attorney, Agent, or Firm*—Yuter, Rosen & Dainow

[57] ABSTRACT

An electrical connector including moisture sealing and self-locking features comprises pins on the plug, shrouded by a hollow sleeve extending from a unitary body formed of a rigid plastic. The receptacle member, of rigid material, includes sockets for receiving the individual pins. The socketed portion of the receptacle member is surrounded by a hollow sleeve which tapers on its inner surface. The plug member sleeve is untapered. A raised resilient band extends continuously around the plug member sleeve, the band being an integral part of the plug member. When the connector members mate the sleeve on the plug member telescopes between the sleeve and the socket portion of the receptacle member with the elastic band compressed against the tapered inner wall of the receptacle sleeve to form a moisture proof seal. A second resilient integral band extends around the sleeve of the plug member and engages an inner peripheral groove, provided in the tapered surface of the receptacle member. In the engaged position, the resilient material seats within the peripheral groove in the receptacle sleeve. Locking engagement is provided.

22 Claims, 10 Drawing Figures

HERMETIC SELF-LOCKING ELECTRICAL CONNECTOR

BACKGROUND OF THE INVENTION

This invention relates generally to an electrical connector of the type using a plug and a receptacle and more particularly to an electrical connector where the plug and receptacle are joined with a telescoping arrangement. The desire for flexibility in wiring interconnection, in the home, in commerce and in industry has led to use of plug and receptacle electrical connectors in many electrical systems and networks where previously hard wiring was used. For example, a simple plug connected to a telephone receiver allows the telephone to be connected to any number of standardized receptacles which can be located throughout a home, office, factory or other facility. Constant improvement in computers and peripherals associated therewith dictate that computer networks be flexible in their ability to add new components such as supplemental memory means, buffers, modems, printers, video displays, etc. etc. Computer terminals, printers, displays and the like with, multi-prong connectors and flat cables between them have become as familiar to the office secretary as typewriters once were. A veritable explosion has occurred in the connector industry especially for connectors and receptacles having large numbers of electrical contacts therein in the form of pins entering sockets or sliding contacts with friction of one surface against another. It is desirable and in many instances the only practical mode of application that these connectors be readily connected and disconnected quickly and preferably without use of tools. The connectors frequently have sleeves with particular contours or include keyways such that misconnections of inter-related components are not possible.

Among other factors, reliability of the electrical and electronic equipment networks in use in various applications, as indicated above, is dependent upon reliability of connection between the many plugs and the receptacles. Accordingly, connectors of the multi-connection type bear little resemblance to the familiar household wall plug but are in themselves devices of precise construction. Performance of devices connected by these connectors is adversely affected when dust and moisture enter the connection, and such happenings can occur whether the connector is frequently or infrequently joined and separated. This problem has not been neglected and many connectors are designed to include sealing means, and those connectors intended for use in a submerged condition are of course designed to be hermetic, where possible, or enclosed. In many prior art connectors one connector member, that is either the plug or the receptacle portion is entirely resilient so that a compression seal can be effected. In other devices both members are entirely resilient, or a separate resilient sleeve or member, for example an "O" ring of circular cross section, is used for sealing. A disadvantage in a connector using separate resilient sleeves or members lies in the need to fabricate and then assemble such separate parts into the completed connector. Also, connectors having one or both members formed entirely of resilient material do not provide the precision in locating mating parts, for example pins and sockets, as is available when both connectors are rigid.

In addition to a need for moisture sealing, connectors frequently require means to assure that connections are locked. To this end some connectors in the prior art have threaded collars which are turned into place after the connector members are mated. Other connectors have wire spring clips which snap over protrusions on the mating part. Other connectors use key ways and pins which are locked together with a partial turn of one member. This leads to complication and expense in construction and assembly and often special tools are needed for locking and unlocking before the connector elements can be joined or separated.

What is needed is a Hermetic Self-Locking Electrical Connector which is simple to fabricate, precise in construction, simple to use in making and breaking connections of the connector, economical to produce and provides both sealing and locking capabilities.

SUMMARY OF THE INVENTION

Generally speaking, in accordance with the invention, an electrical connector including moisture sealing and self-locking features is provided. The electrical connector comprises a receptacle member and mating plug member. The prongs or pins on the plug are shrouded by a hollow sleeve which is an extension of a unitary body formed of a rigid plastic material. The receptacle member, also formed of rigid material, includes a portion having sockets for receiving the individual prongs of the plug member. The socketed portion of the receptacle member is surrounded by a hollow sleeve or shroud which tapers on its inner surface inwardly from the opening. The plug member sleeve is untapered.

A raised band of resilient, elastic material extends continuously around the periphery of the plug member sleeve, the band being a integral part of the plug member. When the two connector members mate with the pins fully received in their corresponding sockets, the sleeve on the plug member telescopes between the sleeve and the socket portion of the receptacle member. As a result, the elastic band is compressed against the tapered inner wall of the receptacle sleeve to form a moisture-proof seal.

A second resilient and integral band, spaced from the first band and generally parallel thereto extends around the periphery of the sleeve of the plug member and engages an inner peripheral groove, provided in the tapered surface of the sleeve in the receptacle member. The second band and the groove within the opening of the recepticle member are juxtaposed when the pins are fully seated in their corresponding sockets. In this engaged position, the resilient material extends across any gap between the plug and receptacle members and seats within the peripheral groove in the receptacle sleeve. Thus, a locking engagement is provided which resists, in conjunction with friction of the pins in their sockets, separation of the connector members and the pins.

The connector face surfaces, exposing the pins in the plug and the sockets in the receptacle member, may be of any crossection, ranging from a round single conductor connector to multi-connection flat cable connectors. Keys and keyways may be provided without any interruption of the seal. All connectors of conventional design are adaptable for inclusion of the subject self-locking and sealing features so long as the connector members provide, or are adapted to provide, a measure of telescoping of members when joined together. The resilient bands are applicable to the rigid member by molding as integral portions, even on irregular contours where separate "O" rings are unsuited because they cannot follow the contours.

Use of rigid materials for both the receptacle and plug members allows for high precision in producing these components. Connectors of many pins or sliding contacts as conventionally used, for example, in connecting peripheral components of computers, are easily and accurately mated.

The above description provides the resilient bands on the plug member. It should be readily apparent that the bands can be provided on the receptacle member with the locking peripheral groove provided in a surface of the plug member.

The rigid materials of the receptacle and plug members may be the same. On the other hand, one member may be plastic and the other metal and in some applications both members may have the telescoping parts formed of metal.

Accordingly, it is an object of this invention to provide an improved hermetic self-locking electrical connector wherein resilient sealing and locking members are formed integral with the bodies of the connector members.

Another object of this invention is to provide an improved hermetic self-locking electrical connector which allows for repetitive, quick and easy connect and disconnect.

A further object of this invention is to provide an improved hermetic self-locking electrical connector which provides resilient sealing without loss of dimensional accuracy and precision.

Still another object of this invention is to provide an improved hermetic self-locking electrical connector which is simple and inexpensive to produce.

Yet another object of this invention is to provide an improved hermetic self-locking electrical connector which maintains a seal where materials of different temperature coefficient of expansion are used for the mating parts.

Still other objects and advantages of the invention will be in part be obvious and will in part be apparent from the specification.

The invention accordingly comprises the features of construction, combination of elements and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
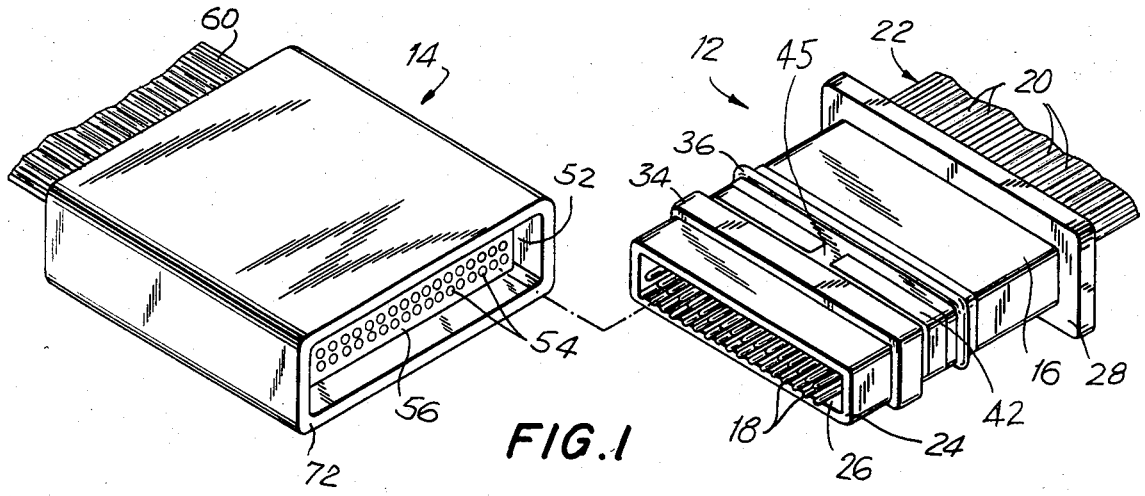
FIG. 1 is an exploded perspective view of the hermetic self-locking electrical connector in accordance with this invention.
Figure 2:
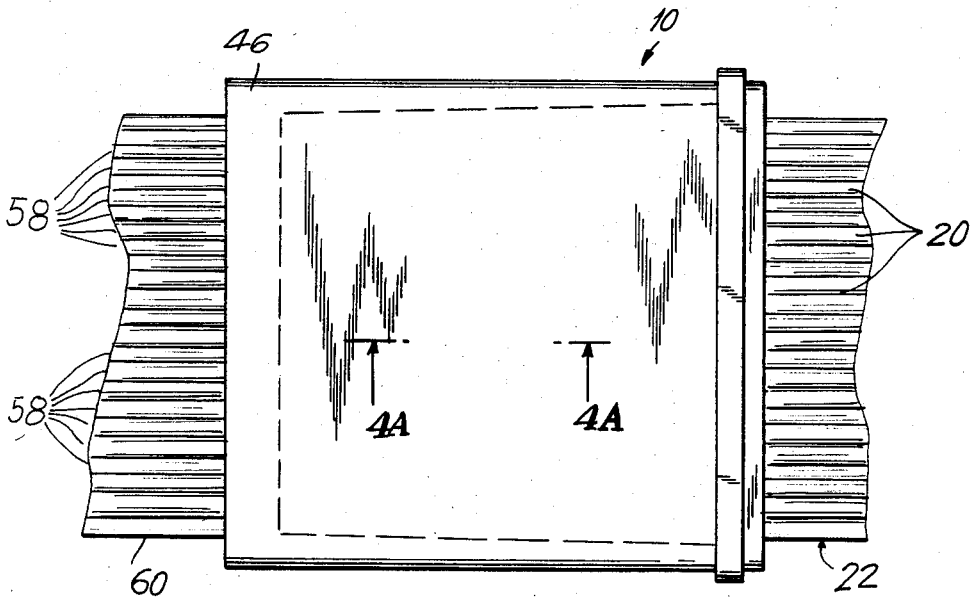
FIG. 2 is a top view of the connector of FIG. 1, shown in the connected condition.
Figure 3:
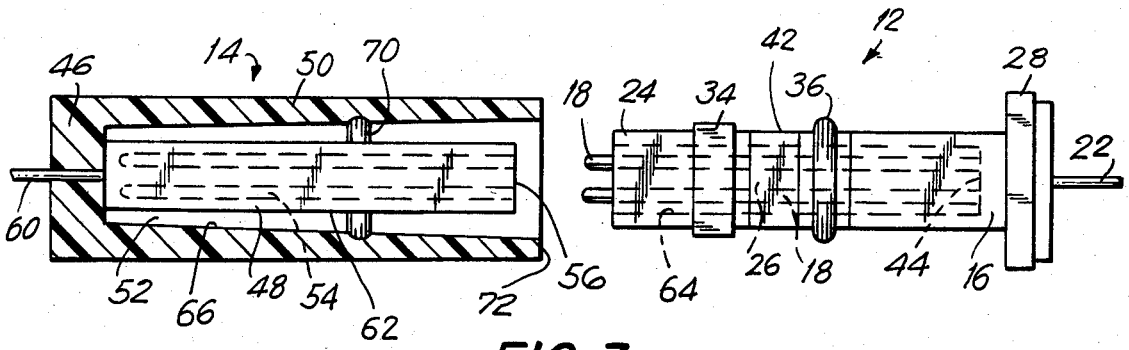
FIG. 3 is a side elevational view partly in section of the connector of FIG. 1 in an opposed but disconnected condition of the members.

With reference to FIGS. 1–4A, the hermetic self-locking electrical connector 10 in accordance with the invention includes a plug member or male member 12 and a female or receptacle member 14. The plug member 12 includes a body 16 from which conductive pins 18 extend in a conventional manner. The pins are connected by electrical conductors (not shown) to individual wires or conductive strips 20 to form a conventional flat cable 22. A sleeve 24 extends from the body 16 and provides a hollow open ended extension of the body 16, the sleeve having relatively thin walls. As illustrated in FIGS. 1 and 3, the pins 18 extend from the body 16 and are at least in part concealed within the hollow 26 enclosed by the sleeve 24.

A stop 28 is formed on the body 16 and provides a finger grip for use in separating the members 12,14 and when connecting the members. A pair of rectangular grooves 30, 32 are formed (FIG. 4A) in the outer surface 42 of the sleeve 24, extending around the surface transversely to the extension of the pins 18. For convenience, the longitudinal direction of the pin axes is here considered as the longitudinal direction of the connector 10. In an alternative embodiment in accordance with the invention one or both grooves 30, 32 are formed on the outer surface of the body portion 16. The grooves are filled with a thermoplastic resin material to form a pair of resilient peripheral members 34, 36, as clearly seen in FIGS. 3 and 4A. The outer extremities 38, 40 of the peripheral members 34, 36 respectively extend transversely from the outer surface 42 of the sleeve 24 and body 16 where the grooves 30, 32 are positioned. The outer extremity 40 of the peripheral member 36 is farther from the surface 42 of this sleeve 24 than is the outer extremity 38 of the peripheral member 34 when the connector members are apart (FIG. 3).

Preferred material for the peripheral members 34, 36 is a elastomeric thermoplastic resin and the preferred material for the male member 12 is any rigid plastic material suitable for the intended environment of the application. The entire male member 12 is formed of the same material as an integral component. The resilient peripheral members 34, 36 are, as stated, of a resilient material which is combined with the rigid body 16 and sleeve 24.

In production, the grooves 30, 32 are filled by inset molding with a thermoplastic resin material which forms the peripheral members 34, 36. An alternative method for forming the peripheral members 34, 36 is as follows; the male body 16 with pins 18 and sleeve 24 is formed by injection molding and, before the plastic material of which the male body 16 and sleeve 24 are made sets, the resilient peripheral members 34, 36 are formed by injection molding of a thermoplastic resin. The plastic resin melt for the bands 34, 36 fills the male body mold, including the grooves 30, 32, and mixes with the plastic material of which the body 16 and sleeve 24 are composed at the mold interface surrounding the grooves 30, 32. Here the primary melt of the male body intimately coalesces with the secondary melt of the thermoplastic resin to form a chemical and mechanical bond between the two materials. Thus the resilient bands 34, 36 are integral with the rigid body 16.

The injection molding step for both the male body 16, sleeve 24 and the peripheral members 34, 36 may take place substantially simultaneously where an appropriate mold for the male body including the peripheral members is fabricated and both primary and secondary mold injection stations are established. Alternatively, the injection molding step of the male body 16 and sleeve 24 occurs first, soon thereafter followed by the injection molding step for the peripheral members 34, 36, the latter injection molding step occurring before the melt composition of the male body 16 and sleeve 24 has entirely set. The injection molding process described above is disclosed in further detail in U.S. Pat. No. 3,950,483.

Each technique described here for forming the peripheral members 34, 36 on the plastic portions of the male or plug member 12 provides an integral bonded construction between the resilient and rigid plastic portions.

The face 44 of the body 16 as viewed in the longitudinal direction may have any shape as is suited to electrical connectors including round, rectangular, truncated triangular, etc. The pattern of pins is determined by the electrical application and is not a novel portion of the invention here. The manner of holding the pins 18 in the body 16 and of extending leads (not shown) from pins to the wires 20 and the flat cable 22 are not a novel portion of this invention and accordingly are not discussed in further detail herein. It should also be understood that in alternative embodiments in accordance with the invention, the sleeve 24 and body 16 may not be of a one piece construction but may be fabricated separately and joined together in any suitable manner. It should also be noted that in an alternative embodiment in accordance with the invention, the transverse rectangular grooves 30, 32 may be joined together by longitudinal channels 45 (FIG. 1) formed in the surface 42 of the sleeve 24 such that in molding, a single feed of the liquid thermoplastic material may be made to fill both grooves 30, 32 simultaneously to form the transverse peripheral members 34, 36, respectively.

The female or receptacle member 14 includes a solid body 46 having an extension member 48 joined thereto. A sleeve 50 extends from the body 46 and encloses the extension member 48 leaving an open space 52 between the sleeve 50 and the extension member 48. A plurality of sockets 54 are recessed into the face surface 56 of the extension member 48 in a pattern and with an opening diameter or diameters which correspond to the distribution and size of the pins 18 in the male or plug member 12. The sockets 54 are electrically connected by leads (not shown) to individual electrical conductors 58 which form a flat cable 60. The outer surfaces 62 of the extension member 48 and the inner surfaces of the sleeve 24 of the male member 12 are contoured such that when the pins 18 are pressed into the sockets 54, as described in further detail hereinafter, the extension member 48 is received within the sleeve 24 of the male member 12. At the same time, the sleeve 24 is received between the extension member 48 and sleeve 50 of the female member 14. The fit between the extension member 48 and the inner surface 64 of the sleeve 24 is with tolerances acceptable in the electrical connector industries for the particular applications.

The inner surface 66 of the sleeve 50 is tapered such that the distance between opposite faces of the inner surface 66 decreases as the distance from the open end of the space 52 increases. In other words, the taper on the inner surfaces 66 reduces the available free space within the female or receptacle member in the longitudinal direction approaching the flat cable 60. A groove 70 of curved crossection extends entirely around the inner surface 66 of the sleeve 50 transversely to the longitudinal direction of the pins 18. Longitudinal positioning of the groove 70 in the female member 14 is such that when the pins 18 are properly seated in the sockets 54, the groove 70 aligns with the rounded protruding portion 40 of the peripheral member 36.

Limits to the insertion of the depth of pins 18 into the sockets 54 may be assured in any conventional manner commonly used in the electrical connector industry. For example, insertion can be limited by the dimensions of the pins and sockets themselves, or motion can be limited when the face surface 56 on the extension member 48 strikes the face 44 of the body 16, or motion can be limited when the stop 28 strikes the end surface 72 on the sleeve 50 of the female member 14.

The female member 14 may be molded as an integral member from the same materials used for the body 16 and sleeve 24 of the male member 12.

When the two connector members 12, 14 are connected, the rectangular extension of resilient material of the peripheral member 34 is compressed by the taper on the inner surface 66 of the sleeve 50, thus providing a seal against moisture. When the two connectors are fully seated, the extended rounded portion of the peripheral member 36 snaps into the curved groove 70 on the inner surface 66 of the sleeve 50. This provides a locking action which can only be broken by exertion of longitudinal force, in the direction which seperates the two connector members 12, 14. Friction of the pins 18 in their respective sockets 54 also serves to prevent unintentional separation of connector members 12, 14.

Although in the embodiment described above, in making a connection the sealing peripheral member 34 enters the open space 52 first, the longitudinal position of the peripheral members 34, 36 on the sleeve surface can be reversed. In such an embodiment, the curved groove 70 is repositioned to receive the rounded projection of the peripheral member 36.

It should also be recognized that in alternative embodiments of an Hermetic Self-Locking Electrical Connector in accordance with the invention, the groove 70 may be formed on the extension member 48 and the resilient members may be formed into rectilinear grooves in the inner surface 64 of the sleeve 24. In such an embodiment, the extension member 48 is tapered such that when the members are connected, the rectangular peripheral member 34 is wedged to form a moisture seal and the rounded peripheral member 36 enters the groove 70 for locking purposes.

Also, it has been described above that the holding peripheral member 36 extends entirely around the outer surface 42 of the sleeve 24. It is not necessary that the resilient member 36 be continuous but it may be intermittent in alternative embodiments. However, the seal member 34 must be continuous if moisture migration is to be successfully inhibited.

Figure 4A:
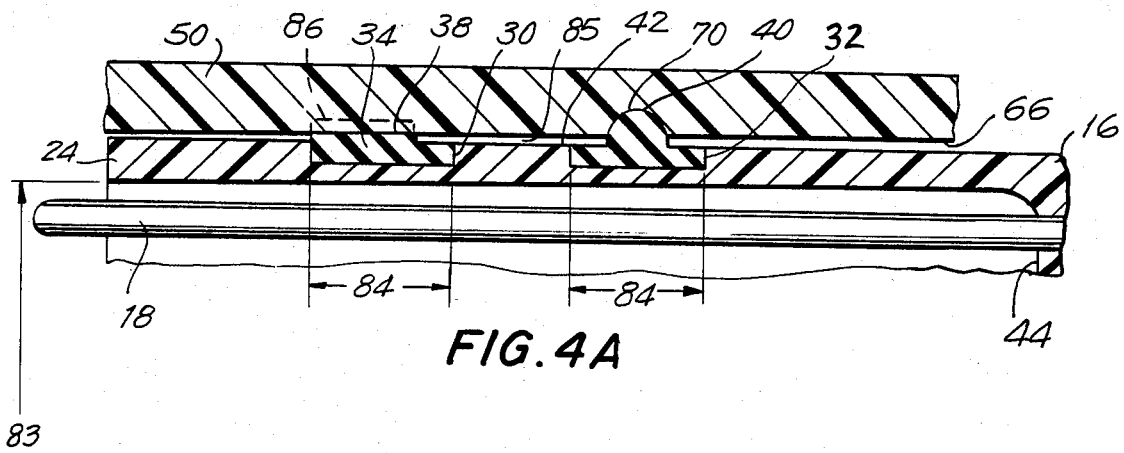
FIG. 4A is a sectional view to an enlarged scale taken along the line 4A—4A of FIG. 2.
Figure 4B:
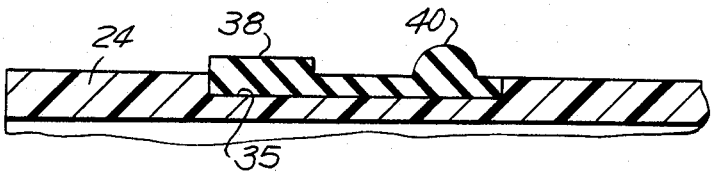
FIG. 4B is a sectional view similar to FIG. 4A of an alternative peripheral member in accordance with the invention.

FIG. 4B indicates an alternative embodiment in accordance with the invention wherein the protruding surfaces 38, 40 are included in a single peripheral member seated in a single groove 35 in the sleeve 24. The functioning of the protruding portions and their dimensions are similar to the embodiment of FIG. 4A, a lock and a seal being provided. A single peripheral member is applicable in all embodiments mentioned or described herein.

Further it should be realized that the opposed surface, for example surface 66 of FIG. 4A, need not be tapered. The sealing protrusion 38 may be curved or wedge shaped and the surface 66 may include a protruding bump, etc., etc. so long as the mating of the connector members compresses the sealing protrusion 38 of the peripheral member between surfaces of the two connector members for sealing when they are joined together and at the same time peripheral portion 40 engages the groove 70 in the opposite member for locking. Further with reference to FIG. 4B the protruding portion 38 may be omitted when the rounded portion 40 has a tight fit in the receiving rounded groove.

Figure 5:
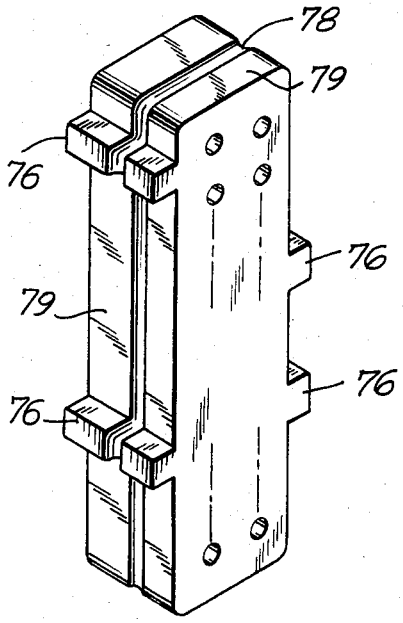
FIG. 5 is a perspective view of an alternative embodiment of the receptacle member of a connector in accordance with the invention.

FIG. 5 illustrates the general contours of a female member of a connector which is commercially available. The connector has keys 76 which are used to guide the male member (not shown) by interengaging with keyways in the mating member when the connector members are joined. In adapting such a connector to the invention disclosed herein, a peripheral groove 78 is formed around the entire periphery of the body and the side surfaces 79 are tapered. This Figure illustrates how the concepts in accordance with the invention are applicable to all shapes of connectors. The male portion of the connector includes a sleeve having contours to mate with the body illustrated in FIG. 5. To adapt to the invention disclosed herein, the sleeve on the male portion is formed with resilient peripheral members on the inner surface of the sleeve such that sealing and locking is accomplished as described above. Further, the body of FIG. 5 may be provided with a sleeve resulting in a construction similar to that illustrated in FIG. 3. A separate "O" ring could not follow such contours as illustrated in FIG. 5.

Figure 6:
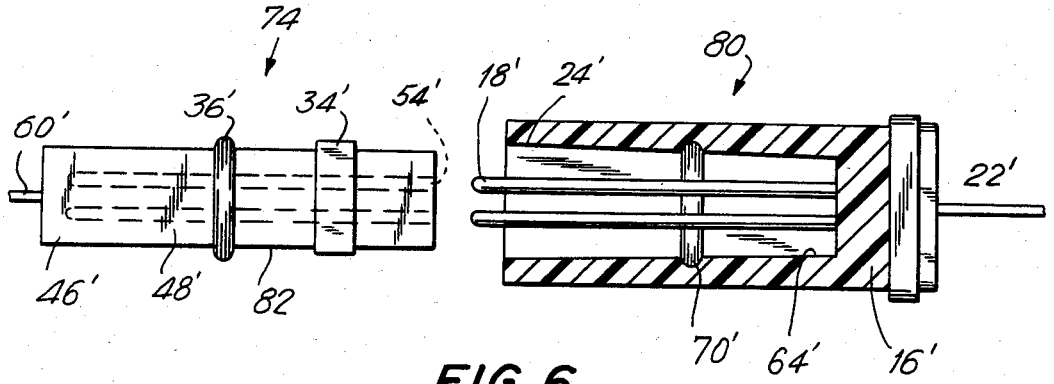
FIG. 6 is a view similar to FIG. 3 of an alternative embodiment of a Hermetic Self-Locking Electrical Connector in accordance with the invention.

FIG. 6 illustrates an alternative embodiment of an hermetic self-locking electrical connector in accordance with the invention. The construction of FIG. 6 is similar to that of FIG. 3 except that the female or receptacle member 74 is unshrouded, that is without an outer sleeve. Sockets 54' are provided to receive pins 18'. The sleeve 24' on the plug member 80 has an inner surface 64' which tapers toward the flat cable 22'.

A sealing peripheral member 34' and a locking peripheral member 36' of resilient material extend from the outer surface 82 of the extension member 48' and peripherally around the female receptacle member 74 in the direction transverse to the longitudinal direction of pin insertion. The inner surface 64' of the sleeve 24' of the male or plug member 80 is formed with a curved groove 70' recessed into the surface. The plug and receptacle members 74, 80 are of rigid material as described above and the peripheral members 34', 36', are of resilient material molded to be integral parts of the receptacle member 74.

As with the electrical connectors in accordance with the invention described above, cross-sectional face shapes, number and arrangement of pins, use of keyways, etc. may be many and varied as suits the electrical application, and fall within the scope of the invention.

In alternative embodiments, positions of pins 18' and sockets 54' may be reversed such that the sockets 54' fall within the sleeve 24'. Also, in an alternative embodiment of FIG. 6, the peripheral members 34', 36' may be formed on the inner surface 64' of the sleeve 24', said inner surface 24' being untapered in this alternative embodiment. Then, a curved groove 70' is provided on the outer surface 82 of the receptacle member 74, the outer surface 82 tapering down toward the open ends of the sockets 54'.

In making a connection using any of these alternative embodiments, the two opposed connected members 74, 80 are telescoped together with the pins 18' inserted in the corresponding sockets 54'. In this process, the sealing peripheral member 34' is compressed against the tapered opposing surface to form a moisture seal in a manner similar to that illustrated in FIG. 4A. The rounded peripheral member 36' engages the curved groove 70' and a lock is formed. The stop position of the telescoping members 74, 80 is determined as described above. The stop position always aligns the peripheral member 36' with the curved groove 70'. Thus, sealing and locking is accomplished. In every embodiment the compressed seal 34' extends entirely around the periphery of the associated member, being compressed against a tapered surface. The locking peripheral member 36' may be continuous or discontinuous.

Figure 9:
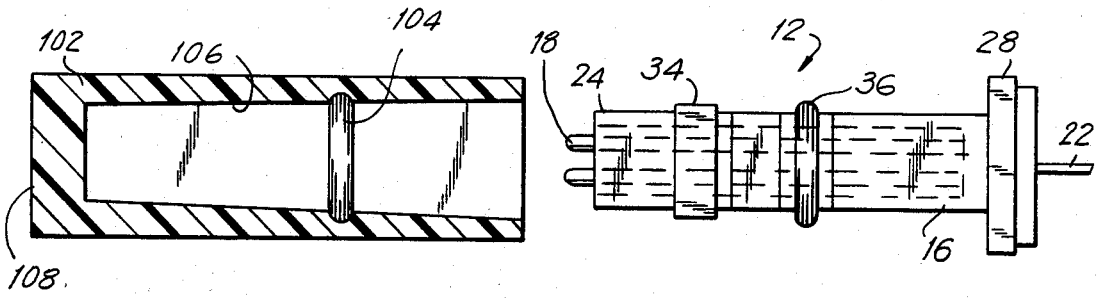
FIG. 9 is a view similar to FIG. 3 with a protective cap used in place of a receptacle member.

In the illustrated embodiments, the two members of the electrical connector are shown at the ends of flat cables. It should be understood that the female receptacle, or the male plug if desired, may be mounted in a cabinet or wall such that only the mating member is located at the end of a flexible movable cable. Also the cable need not be flat but may be of any conventional crossection. Further, one connector member may serve as a "dummy", that is a cap or cover for the other member, for example when equipment is shipped as an unassembled component of a system. The cap or cover includes the features for locking and sealing with the completely functional associated member, but the cap includes no electrical elements, i.e. pins, receptacles, conductors, etc., and is closed off where the cable would normally be connected on a fully functional member. FIG. 9 is a view similar to FIG. 3, illustrating the receptacle member 14 of FIG. 3 replaced with a cap 102 which includes a groove 104 for mating with the peripheral member 36 of the plug member 12, and having an inwardly tapering wall 106 for engagement with the sealing member 34, and having a closed end 108 where the cable is present in FIG. 3. It should be understood that alternatively a cap may be provided to replace the other member 12 of the connector for protecting a functional member 14.

The plug and receptacle members 12, 14, 74, 80, may both be of the same rigid material for examples a high density polyethylene, ABS, PVC or polypropylene. The resilient members 34, 36, 34', 36', for examples, are formed of an elastomeric thermoplastic resin such as polyurethane, TPR or Santoprene, manufactured by Monsanto Chemical Corporation or may be natural or synthetic rubber. It should be noted again that when a tight fit is provided between a continuous locking peripheral member 36 and the curved groove 70, locking as well as moisture sealing may be effected without use of the other peripheral sealing member 34. It should also be understood that in alternative embodiments the sealing member may be curved, wavy, notched, etc. (not shown) as viewed from the top and side (FIGS. 1,3).

The connector members are quickly connected in one pushing action by force applied along one common longitudinal axis. All that is required to disconnect the members is a pulling force, again along the common longitudinal axis. Sufficient force must be applied to overcome the seating of the peripheral member 36 in the groove 70. Since the member 36 is resiliently deformable, as the pulling force increases, the member 36 eventually gives way and leaves the groove 70. However, the locking force is sufficient such that under normal use the connector members do not separate. It should also be recognized that friction between the pins and their sockets may also aid in keeping the connector together and provides an additional resistance which must be overcome with additional force upon separation of the members.

With reference to FIG. 4A, in a connector in accordance with the invention wherein the internally telescoping member has a height 83 of approximately one half inch, the width 84 of the peripheral members 34, 36 is in the order of 1/16 inch and the curved portion 40 has a diameter of 0.030 inches with an elevation above the surface 42 of approximately 0.012 inches. Before compression, the peripheral member 34 extends above the surface 42 by approximately 0.018 inches. The curved groove 70 is 0.004 inches deep and 0.023 inches in width. The radius of curvature of the groove 70 corresponds to the radius of curvature of the peripheral member 36. Thus, a gap 85 remains between the sleeve 24 and the opposed telescoping surface 66 adjacent the peripheral member 36. This spacing is not constant recognizing that the surface 66 tapers, and the surfaces 66, 42 are closer together adjacent the sealing peripheral member 34. The broken line 86 illustrates the uncompressed condition of the member 34 prior to insertion within the outer sleeve 50.

Figure 8:
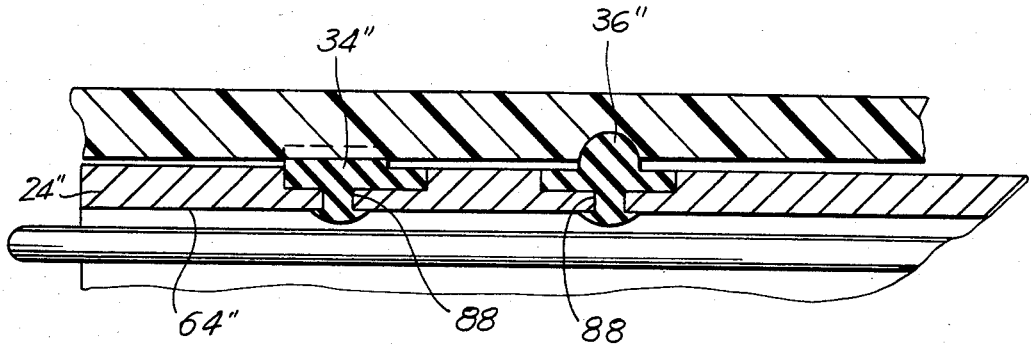
FIG. 8 is a view similar to FIG. 4A illustrating attachment of peripheral resilient bands by molding when a metal member is used.

The embodiments described above included male and female members made of the same rigid plastic. In an alternative embodiment in accordance with the invention, one member may be of plastic and the other of metal. FIG. 8 illustrates peripheral members 34'', 36'' on a metal sleeve 24''. Holes 88 are located at regular intervals around the periphery of the sleeve and when the resilient peripheral members 34'', 36'' are injection molded, the fluid material flows through the holes 88 and spreads on the other side 64'' of the sleeve. Recesses may be used on the back side 64'' of the sleeve 24'' to provide a better grip for the resilient material. In all other respects construction and performance of the hermetic self locking electrical connector in accordance with the invention is the same as in the embodiments described above using rigid plastic bodies. It should also be understood that both members of the connector may be of metal with one member having the resilient members formed thereon and a groove formed in the other member to receive the sealing peripheral member.

Figure 7:
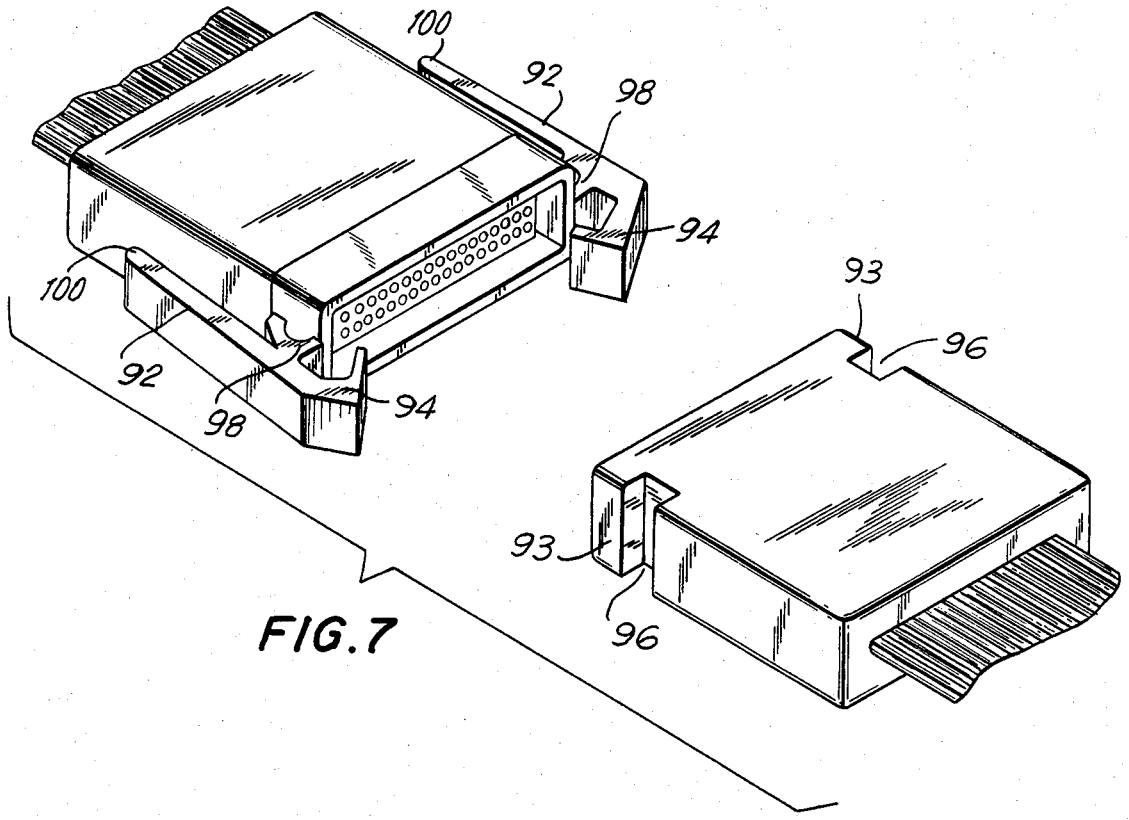
FIG. 7 is a perspective view of a connector in accordance with the invention and further including external gripping devices.

FIG. 7 illustrates another alternative embodiment of a connector in accordance with the invention including the resilient peripheral members and groove. Grippers 92 of a semi-rigid construction are mounted on one connector member. When the connector is mated with the corresponding member, the grippers 92 flex and slide along the side surfaces 93 of the receptacle member until the hook ends 94 of the grippers 92 engage slots 96 on the side 93 of the receptacle member. This engagement keeps the plug and receptacle members together, supplementing the resilient locking peripheral member. The material used in forming the grippers 92 is flexible and allows pivoting of the arms about the support members 98. The grippers 92 are released from the slots 96 by application of inward finger pressure, that is, sqeezing the two grippers together, at the remote ends 100. Also it should be understood that in an alternative embodiment in accordance with the invention the slots 96 can be replaced with a protruding rib which is engaged by the hook ends 94.

It will thus be seen that the objects set forth above, among those made apparent from the preceding description, are efficiently attained and, since certain changes may be made in the above constructions without departing from the spirit and scope of the invention, it is intended that all matter contained in the above description and shown in the accompanying drawings shall be interpreted as illustrative and not in a limiting sense.

It is also to be understood that following claims are intended to cover all of the generic and specific features of the invention herein described, and all statements of the scope of the invention which, as a matter of language, might be said to fall therebetween.

What is claimed is:

1. An electrical connector including a plug member and a receptacle member, said members being connected by motion toward each other and disconnected by motion in the opposite direction, the improvement therein comprising:

a first groove formed in a first rigid surface of a first one of said connector members, said groove extending transversely to said connecting and disconnecting directions;

a resilient first peripheral member protruding from a second rigid surface of the second one of said connector members and extending transversely to said connecting and disconnecting directions, said resilient first peripheral member being integrally formed on said rigid surface of second connector member, said first and second rigid surfaces having at least in part a telescopic relationship and at least part of the protruding portion of said resilient first peripheral member engaging said first groove of said first connector member when said plug and receptacle members are connected, pulling apart of said members being inhibited by said engagement of said first peripheral member in said first groove.

2. An electrical connector as claimed in claim 1, and further comprising a resilient second peripheral member protruding from said rigid surface of said second connector member and extending transversely to said connecting and disconnecting directions and around said second connector member, said resilient second peripheral member being integrally formed on said rigid second surface of said second connector member and being compressed between said first and second surfaces of said connector members when said plug and receptacle members are mated, a seal being formed between said second peripheral member and said first surface when said connector members are connected.

3. An electrical connector as claimed in claim 2, wherein said rigid first surface of said first connector member is tapered and said resilient second peripheral member extends continuously around said second connector member.

4. An electrical connector as claimed in claim 2, wherein said first and second peripheral members are seated in second and third grooves respectively, said second and third grooves being formed in said second surface of said second connector member.

5. An electrical connector as claimed in claim 1, wherein said first peripheral member extends continuously around said second surface of said second connector member, said first peripheral member forming a continuous seal within said first groove.

6. An electrical connector as claimed in claim 4, wherein said second peripheral member is generally rectangular in cross section and said third groove is rectangular in cross section.

7. An electrical connector as claimed in claim 6, wherein said second peripheral groove is rectangular.

8. An electrical connector as claimed in claim 2, wherein said protruding portion of said first peripheral member is rounded in cross-section and said first groove is rounded in cross-section.

9. An electrical connector as claimed in claim 2, wherein said first and second surfaces are separated by a gap when said connector members are connected.

10. An electrical connector as claimed in claim 9, wherein, the protrusion of said resilient first peripheral member from said rigid second surface of said second connecting member is greater than the protrusion of said resilient second peripheral member when said connector members are separated one from the other.

11. An electrical connector as claimed in claim 2 and further comprising electrical terminals in one of said plug member and receptacle member, the connector member without electrical terminals being closed off at one end, the connector member with electrical terminals being sealed from the ambient and locked to said other member by connection of said members by said motion toward each other, said connector member without electrical terminals being a cap and seal for said other member having electrical terminals.

12. An electrical connector as claimed in claim 11, wherein said rigid first and second surfaces encompass at least in part said electrical terminals in said associated respective connector members.

13. An electrical connector as claimed in claim 2, and further comprising electrical terminals in said plug and receptacle members, at least a portion of the terminals in said plug member being electrically connected to electrical terminals in said receptacle member when said connector members are connected together, and electrical leads extending from said connector members, said leads being connected to respective terminals in said members.

14. An electrical connector including a plug member and a receptacle member, said members being connected by motion toward each other and disconnected by motion in the opposite direction, the improvement therein comprising:

a first groove formed in a first rigid surface of a first one of said connector members, said groove extending transversely to said connecting and disconnecting directions;

a resilient peripheral member protruding from a rigid second surface of the second one of said connector members and extending transversely to said connecting and disconnecting directions, said resilient peripheral member being integrally formed on said second connector member, said rigid first and second surfaces having at least in part a telescopic relationship, a first portion of said peripheral member engaging at least in part in said first groove of said first connector member when said plug and receptacle members are connected, pulling apart of said members being inhibited by said engagement of said first portion of said resilient peripheral member in said first groove, another portion of said peripheral member protruding from said rigid second surface and extending around said second connector member and being compressed between said rigid first surface and said rigid second surface of said connector members when said plug and receptacle members are mated, a seal being formed between said second portion of said peripheral member and said first surface when said members are connected.

15. An electrical connector as claimed in claim 14, wherein said first surface of said first connector member is tapered.

16. An electrical connector as claimed in claim 2, wherein said peripheral members are formed of one of a group of elastomeric thermoplastic resins consisting of polyurethane, TPR, Santoprene, natural rubber and synthetic rubber, synthetic rubber, TPR, and said connector members are formed of one of a group of rigid plastics consisting of ABS, polypropylene, PVC and polyethylene.

17. An electrical connector as claimed in claim 16, wherein said peripheral members and said connector members are products of successive injection molding processes.

18. An electrical connector as claimed in claim 14, wherein said peripheral member is formed in a groove in the second surface of said second connector member.

19. An electrical connector as claimed in claim 1, wherein said protruding portion of said first peripheral member is rounded in cross-section and said first groove is rounded in cross-section.

20. An electrical connector as claimed in claim 14 and further comprising electrical terminals in one of said plug member and receptacle member, the connector member without electrical terminals being closed off at one end, the connector member with electrical terminals being sealed from the ambient and locked to said other member by connection of said members by said motion toward each other said connector member without electrical terminals being a cap and seal for said other member having electrical terminals.

21. An electrical connector including a plug member and a receptacle member, said members being connected by motion toward each other and disconnected by motion in the opposite direction, the improvement therein comprising:

a first rigid surface on a first one of said connector members:

a resilient peripheral member protruding from a second rigid surface of the second connector member and extending transversely to said connecting and disconnecting directions and around said second connector member, said resilient peripheral member being integrally formed on said rigid second surface of said second connector member and being compressed between said first and second surfaces of said connector members when said plug and receptacle members are mated, a seal being formed between said second peripheral member and said first surface when said connector members are connected.

22. An electrical connector as claimed in claim 21, wherein said rigid first surface of said first connector member is tapered and said resilient peripheral member extends continuously around said second connector member.

* * * * *